US008929793B2

(12) United States Patent
Boesten et al.

(10) Patent No.: US 8,929,793 B2
(45) Date of Patent: Jan. 6, 2015

(54) RECORDING SUBSTRATE TREATMENT APPARATUS AND METHOD

(71) Applicant: Oce Technologies B.V., Venlo (NL)

(72) Inventors: Hubertus M. J. M. Boesten, Heythuysen (NL); Antonius J. J. Van Gerven, Grubbenvorst (NL); Peter J. Hollands, Baarlo (NL); Albert M. Van Beek, 'S-Hertogenbosch (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 13/768,658

(22) Filed: Feb. 15, 2013

(65) Prior Publication Data

US 2013/0156473 A1 Jun. 20, 2013

Related U.S. Application Data

(63) Continuation of application No. PCT/EP2011/066150, filed on Sep. 16, 2011.

(30) Foreign Application Priority Data

Sep. 27, 2010 (EP) ..... 10179943

(51) Int. Cl.

| | |
|---|---|
| ***G03G 15/20*** | (2006.01) |
| ***G03G 15/00*** | (2006.01) |
| ***G03G 9/08*** | (2006.01) |
| ***G03G 21/20*** | (2006.01) |
| ***B41J 11/00*** | (2006.01) |

(52) U.S. Cl.

CPC ..... *G03G 21/203* (2013.01); *B41J 11/002* (2013.01)

USPC ..... 399/335; 399/320; 399/390; 347/155; 347/156

(58) Field of Classification Search

USPC ..... 399/320, 390

See application file for complete search history.

(56) References Cited

U.S. PATENT DOCUMENTS

| | | | | |
|---|---|---|---|---|
| 4,733,272 | A * | 3/1988 | Howe et al. | 399/250 |
| 2004/0126160 | A1 | 7/2004 | Keidel et al. | |
| 2006/0228128 | A1 | 10/2006 | Reihl | |

FOREIGN PATENT DOCUMENTS

| | | | |
|---|---|---|---|
| DE | 28 11 835 | A1 | 9/1979 |
| DE | 102 46 901 | C1 | 12/2003 |
| DE | 10 2005 016 296 | A1 | 10/2006 |
| GB | 2 010 104 | A | 6/1979 |
| JP | 2-26751 | A | 1/1990 |

* cited by examiner

*Primary Examiner* — David Gray
*Assistant Examiner* — Andrew V Do
(74) *Attorney, Agent, or Firm* — Birch, Stewart, Kolasch & Birch, LLP

(57) ABSTRACT

A recording substrate treatment apparatus, includes a heating device for directly heating a recording substrate, a condenser for condensing liquid from air from surroundings of a recording substrate, and an energy transfer system arranged for transferring energy from latent heat, which is released by the condensing of liquid by the condenser, to the heating device. Further, a method of drying a recording substrate and a method of fixing a printing substance on a recording substrate include heating a recording substrate by a heating device; condensing liquid from air from surroundings of the recording substrate; and transferring energy from latent heat, which is released by the condensing of liquid, to the heating device.

19 Claims, 3 Drawing Sheets

RECORDING SUBSTRATE TREATMENT APPARATUS AND METHOD

CROSS REFERENCE TO RELATED APPLICATIONS

This application is a Continuation of PCT International Application No. PCT/EP2011/066150 filed on Sep. 16, 2011, which claims priority under 35 U.S.C. §119(a) to Patent Application No. 10179943.5 filed in Europe on Sep. 27, 2010, all of which are hereby expressly incorporated by reference into the present application.

BACKGROUND OF THE INVENTION

1. Field of the Invention

The invention relates to a recording substrate treatment apparatus, in particular a recording substrate treatment apparatus for a printer or copier. For example, the recording substrate treatment apparatus comprises at least one of a drying device for drying a recording substrate and a fixing device for fixing a printing substance on a recording substrate. For example, the fixing device may be or comprise a fuser.

2. Description of Background Art

In the field of copying and printing, it is known to dry or fix prints on a recording substrate. For example, a fuser is known for fixing toner powder to a printing substrate, such as a sheet of paper. For example, a fuser comprises a radiant heat lamp may be arranged to heat a printing substrate support roller for heating and bonding the toner to the paper.

GB 20 10 104 A describes a method and apparatus for evaporating and condensing a printing ink solvent from air from drying a printed paper web. The solvent vapor is condensed by a refrigerator unit evaporator and the heat extracted from the vapor, recirculated in the refrigerant medium to a refrigerator unit condenser. The cooled air, wholly or partially freed from entrained solvent vapor, is heated by the refrigidating medium passing through the condenser. The thus heated air is then passed into a chamber through which the web is passed, via an optional auxiliary thermostatically controlled heater.

SUMMARY OF THE INVENTION

The fixing of a printing substance to a recording sheet usually involves heating the recording substrate comprising the printing substance and evaporating a solvent and/or water stemming from the printing substance.

When hot, moist air escapes e.g. from a fuser, this can lead to undesirable heating of other machine parts and/or condensation on cold surfaces such as paper guiding plates, output rollers, etc., which potentially causes printing defects. For example, when hot, moist air from a fuser heats up paper output rollers, re-printing could be the result.

It is an object of the invention to provide a recording substrate treatment apparatus wherein uncontrolled hot air streams escaping the apparatus at recording substrate entry and/or exit openings may be minimized or avoided.

In order to facilitate achieving one or more of these objects, according to the invention, there is provided a recording substrate treatment apparatus, comprising:

- a heating device for directly heating a recording substrate,
- a condenser for condensing liquid from air from surroundings of a recording substrate,
- an energy transfer system arranged for transferring energy from latent heat, which is released by said condensing of liquid by the condenser, to the heating device.

Drying or fixing of prints made using aqueous ink, such as latex ink, demands a large amount of energy for removing the water that is supplied with the ink from the print. The required energy may be provided by a heating device that is arranged to directly heat the recording substrate. In the context of the present invention, directly heating the recording substrate is to be construed as providing the required energy straight to the recording substrate, for example by passing the recording substrate over a heat plate or by irradiating the recording substrate with a radiant heater. Direct heating therefore excludes indirect heating of the recording substrate by heating a gaseous medium and in particular air, prior to passing the heated gaseous medium over the recording substrate. Examples of heating devices that are suitable to provide direct heating of the recording substrate may thus be a heat plate and a radiant heater. The moist air generated in the recording substrate treatment apparatus during operation in particular in the surroundings of the recording substrate may contain a relatively large amount of latent energy, which may be transferred to the heating device. For example, the latent energy is transferred to the heating device in order to contribute to heating a recording substrate. For example, latent heat stemming from a printing substance on a first recording substrate or a first part of a recording substrate may contribute to heating a different, subsequent recording substrate or a second part of the recording substrate. In any case, by condensing the evaporated liquid stemming from the printing substance, the air is dried and cooled. Consequently, the air escaping the apparatus at entry and exit openings is dry and cool.

For example, the heating device may be adapted for heating a recording substrate at a recording substrate entry side of the treatment apparatus. For example, the heating device may be arranged for pre-heating a recording substrate that is to be treated.

Useful details of the invention are indicated in the dependent claims.

In an embodiment, the recording substrate treatment apparatus further comprises a conduit for supplying to a recording substrate a stream of air cooled by the condenser.

An advantage of the present embodiment is that a flow of dried cool air to the recording substrate refreshes the air in the surroundings of the recording substrate which may increase the drying capacity of the recording substrate apparatus.

Another advantage of the present embodiment is that when at least a part of the stream of dried cool air is supplied to the recording substrate near the recording substrate exit of the recording substrate treatment apparatus, the recording substrate may be cooled before leaving the recording substrate treatment apparatus, which may improve the energy efficiency of the recording substrate apparatus.

In an embodiment, the recording substrate treatment apparatus further comprises at least one of a drying device for drying a recording substrate and a fixing device for fixing a printing substance on a recording substrate. For example, the drying/fixing device may be provided separate from the abovementioned first heating device. For example, the drying/fixing device may be a second heating device. For example, the first heating device may be arranged upstream of the drying/fixing device in a recording substrate transport direction. The first heating device may contribute to drying/fixing. For example, the first heating device may be arranged to pre-heat a recording substrate.

For example, the recording substrate treatment apparatus may comprise a ventilation unit for exhausting air from surroundings of a recording substrate and transporting said air to the condenser.

In an embodiment, the condenser comprises a heat exchanger adapted for condensing liquid from air at a first side of the heat exchanger and for providing energy from latent heat, which is released by said condensing of liquid, at a second side of the heat exchanger, the second side being separate from said first side. Thus, the condenser may provide cooled air and may provide said energy from latent heat separate from said cooled air. Nevertheless, in an embodiment, said provided energy may be used to heat said cooled air provided from the condenser. For example, dried, reheated air may be recycled to surroundings of a printing substrate.

For example, the energy transfer system may comprise a heat pump. For example, the heat pump may be adapted to provide, at a heating device side of the heat pump, a higher temperature than a temperature at a condenser side of the heat pump. In an embodiment, the energy transfer system employs a heat transfer fluid. Such an energy transfer fluid may be any fluid well known in the art for use as a heat transport fluid (e.g. the fluid known as R134a). It is however envisaged that advantageously carbon dioxide (as a heat transfer fluid also referred to as R744) may be employed in view of the temperature that may be reached in an embodiment of a drying device arranged in a printing apparatus.

Further, it is envisaged that energy may be retrieved not only from condensing evaporated liquid stemming from the printing substance, but also from the printing substrate that was heated to evaporate said liquid. So, in an embodiment, a printing apparatus is provided with means such as a suitable heat pump to receive heat from a substrate at the moment that such substrate has been heated e.g. for drying.

In another or further embodiment, energy may be retrieved from other parts of the printing apparatus. For example, heated air may be cooled and retrieved heat energy may be transferred to the heating device of the present invention. Similarly, employing a suitable heat transfer system such as a heat pump heat energy may be retrieved from an environment of the printing apparatus and supplied to the heating device. The environment may be heated by the printing apparatus and may thus be cooled again, while at least partly reusing the earlier consumed energy.

In an embodiment, an air supply conduit is arranged to supply an air stream on a printing sub-stance carrying side of the recording substrate. In an embodiment, the conduit is arranged to supply said air stream at a printing substrate entry opening and/or printing substrate exit opening of the recording substrate treatment apparatus.

In a further aspect of the invention, there is provided a method of drying a recording substrate, comprising:

heating a recording substrate by a heating device;

condensing liquid from air from surroundings of the recording substrate by a condenser;

transferring energy from latent heat, which is released by said condensing of liquid, to said heating device.

The heating device used in the heating step of the method according to the present embodiment is arranged to directly heat the recording substrate as explained hereinabove.

In an embodiment, the method of drying a recording substrate further comprises the step of supplying to a recording substrate a stream of dried cool air cooled by the condenser.

For example, the method is a method of drying a recording substrate comprising a printing substance printed onto the recording substrate.

In a further aspect of the invention, there is provided a method of fixing a printing substance on a recording substrate, comprising:

heating a recording substrate by a heating device, condensing liquid from air from surroundings of the recording substrate by a condenser;

transferring energy from latent heat, which is released by said condensing of liquid, to said heating device.

The heating device used in the heating step of the method according to the present embodiment is arranged to directly heat the recording substrate as explained hereinabove.

In an embodiment, the method of fixing a printing substance on a recording substrate further comprises the step of supplying to a recording substrate a stream of dried cool air cooled by the condenser.

For example, the method may comprise a step of fixing a printing substance on a recording substrate, said step comprising at least one of:

drying a recording substrate comprising the printing substance, and fusing the printing substance to a recording substrate.

In a further aspect of the invention, there is provided a recording substrate treatment apparatus, comprising:

a heating device for directly heating a recording substrate, at least one outlet for air from surroundings of a recording substrate transport path, an upper boundary surface of surroundings of a recording substrate transport path, which boundary surface rises towards said at least one outlet for guiding hot air towards said at least one outlet.

This aspect of the invention may also be implemented independent from the abovementioned aspects of the invention.

Thus, by guiding hot air towards the at least one outlet, uncontrolled escaping of hot, moist air from the treatment apparatus may be avoided. Instead, there may e.g. even be an air inflow at recording substrate entry and/or exit openings of the treatment apparatus.

In an embodiment, the recording substrate treatment apparatus further comprises at least one of a drying device for drying a recording substrate and a fixing device for fixing a printing substance on a recording substrate.

For example, the recording substrate treatment apparatus may comprise a ventilation unit for exhausting air from surroundings of a recording substrate through the at least one outlet.

In an embodiment, when seen in a recording substrate transport direction, said at least one outlet is arranged between a first upper boundary surface, which rises towards said at least one outlet, and a second upper boundary surface, which rises towards said at least one outlet. Thus, air transport may be optimized.

For example, first and second upper boundary surfaces may rise in opposite directions towards said at least one outlet. Thus, air transport may be optimized. For example, said at least one air outlet may be arranged centrally between recording substrate entry and exit openings of the apparatus or of a housing of the apparatus.

The features of this aspect of the invention may be advantageously combined with features of other aspects of the invention. For example, the treatment apparatus may comprise a ventilation unit for exhausting air from surroundings of a recording substrate trans-port path via the outlet and transporting said air to the condenser.

In a further aspect of the invention, there is provided a method of drying a recording substrate, comprising:

heating a recording substrate by a heating device; and guiding air from surroundings of the recording substrate to at least one outlet by an upper boundary surface of surroundings of a recording substrate transport path, which boundary surface rises towards said at least one outlet.

This aspect of the invention may be implemented independent from the abovementioned aspects of the invention.

In a further aspect of the invention, there is provided a method of fixing a printing substance on a recording substrate, comprising:

heating a recording substrate by a heating device; and guiding air from surroundings of the recording substrate to at least one outlet by an upper boundary surface of surroundings of a recording substrate transport path, which boundary surface rises towards said at least one outlet.

This aspect of the invention may be implemented independent from the abovementioned aspects of the invention.

BRIEF DESCRIPTION OF THE DRAWINGS

The present invention will become more fully understood from the detailed description given herein below and accompanying drawings which are given by way of illustration only and are not limitative of the invention, and wherein.

DETAILED DESCRIPTION OF THE PREFERRED EMBODIMENTS

Figure 1:
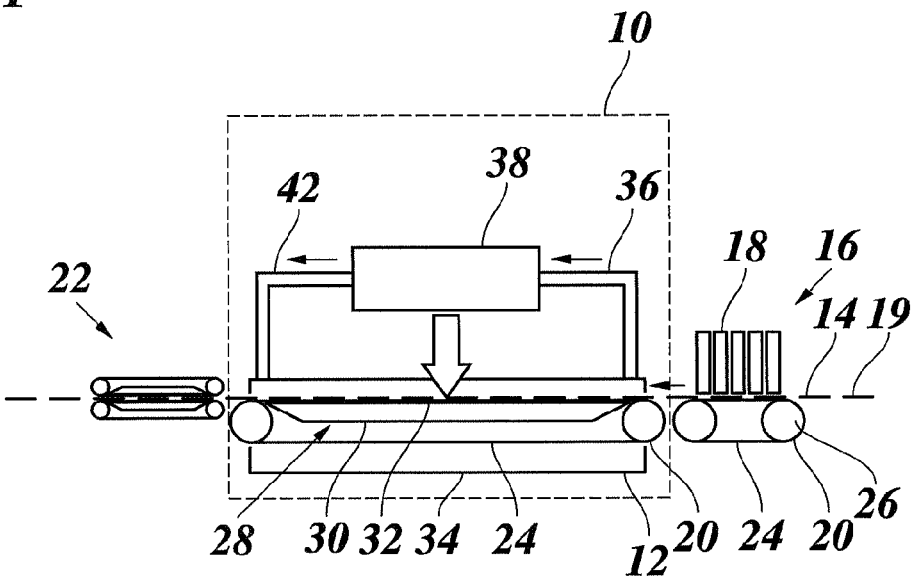
FIG. 1 is a schematic view showing an image forming apparatus with a recording substrate treatment apparatus for fixing a printing substance on a recording substrate.
Figure 2:
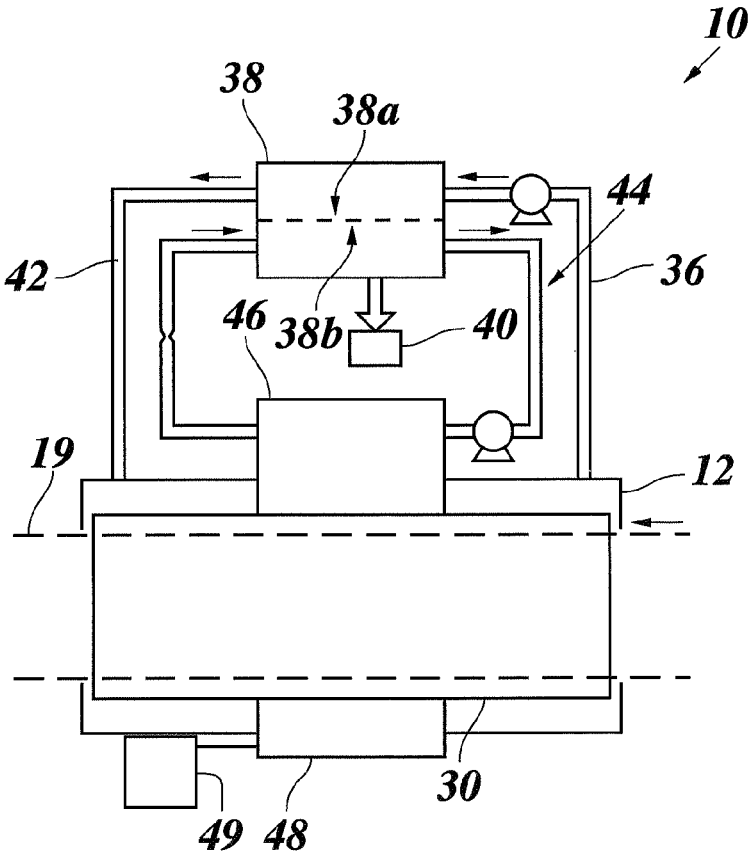
FIG. 2 is a schematic view showing details of the recording substrate treatment apparatus.

FIG. 1 shows a schematic view of an image forming apparatus or printing system comprising a recording substrate treatment apparatus 10 according to the invention. FIG. 2 schematically shows further details of the recording substrate treatment apparatus 10.

The treatment apparatus 10 comprises a drying/fixing device 12 for drying a recording substrate 14 and thereby fixing a printing substance on the recording substrate 14.

The printing system further comprises an image forming unit or printing unit 16 that comprises at least one print head 18. In FIG. 1, five ink jet print heads 18 are arranged above a sheet transport path 19 that is schematically illustrated by a dashed line. Sheet transport means 20 are arranged for transporting a recording substrate 14, e.g. a paper sheet, along the transport path 19 past the print heads 18 and further through the recording substrate treating apparatus 10. For example, the print heads 18 print a printing substance in the form of aqueous ink, such as e.g. latex ink, onto the recording substrate 14 in accordance with an image to be printed. Downstream of the treatment apparatus 10, a cooling unit 22 is arranged at the transport path for cooling the recording substrate 14. For example, the sheet transport means comprise one or more belts 24 mounted on rollers 26.

The drying/fixing device 12 comprises a heating device 28 for directly heating a recording substrate 14. The heating device 28 comprises a heat plate 30 and a support member 32 e.g. in form of a belt 24 of the sheet transport means 20, which belt is movable along a first (upper) side of the heat plate 30. Thus, the support member 32 is a belt for supporting the recording substrate 14 at a first (upper) side thereof and for receiving heat at a second (bottom) side thereof. The heat is received from the heat plate 30, which is arranged at the second side of the belt.

By heating a recording substrate 14 from the heating device 28, the recording substrate 14 is dried, and thereby, the printing substance in the form of the aqueous ink is fixed on the recording substrate 14. Water evaporates from the recording substrate into the air surrounding the recording substrate in a housing 34 of the drying/fixing device 12. The recording substrate treatment apparatus 10 further comprises a ventilation unit comprising a conduit 36 for exhausting air from the drying/fixing device 12. For example, the conduit 36 is arranged for exhausting air on a recording substrate entry side of the housing 34. The conduit 36 is connected to a condenser 38 for condensing liquid, in particular moisture or water, from the air from the conduit 36.

For example, the condenser 38 comprises a heat exchanger. As is schematically shown in FIG. 2, liquid from the air from the conduit 36 is condensed at a first side 38*a* of the heat exchanger, and energy from latent heat, which is released by said condensing of liquid, is provided to a heat transport fluid at a second side 38*b* of the heat exchanger. Also, sensible heat is transferred from the air to the heat transport fluid. The second side 38*b* is separate from the first side 38*a* of the heat exchanger. For example, the first and second sides are opposite sides of a separation wall of the heat exchanger separating the air from the heat transport fluid. The condensed liquid is, for example, collected in a reservoir 40.

Thus, on the first side of the heat exchanger, the air from the conduit 36 is cooled, and dry, cold air is provided and transported through a conduit 42 to the drying/fixing device 12 on a recording substrate exit side of the housing 34.

The recording substrate treatment apparatus 10 further comprises an energy transfer system for transferring the energy, which is provided to the heat transport fluid in the heat exchanger of the condenser 38, to the heating device 28. Thus, as schematically shown in FIG. 1 by an open arrow, energy from latent heat, which is released by the condensing of liquid by the condenser 38, as well as heat energy transferred from the hot air from conduit 36 to the heat transport fluid, is transferred to the heating device 28.

The energy transport system comprises, for example, a heat pump 44 using the heat transport fluid as a working fluid. For example, the heat transport fluid may be a refrigerant that is evaporated on the second side of the heat exchanger of the condenser 38 and is condensed in a further heat exchanger 46 of the heat pump 44. Thus, both the heat exchanger of the condenser 38 and the heat exchanger 46 each form a part of the heat pump.

The heat exchanger 46 is arranged for transferring heat from the condensing heat transport fluid to the heat plate 30. For example, the heat exchanger 46 is in heat conductive contact with the heat plate 30.

Thus, the heat pump 44 may provide a higher temperature at the heat plate 30 than a temperature at the condenser side of the heat pump 44 and/or than a temperature of the air exhausted from the surroundings of the recording substrate 14 in the drying/fixing device 12. Latent heat of evaporated water from the aqueous ink is retrieved and transformed by the heat pump 44 for supplying energy to the conductive heat plate 30.

For example, further conventional heating means 48 may be provided for heating the heat plate 30. For example, temperature regulating means 49 may be provided to regulate the temperature of the heat plate 30 and, thus, the temperature of the recording substrate 14 in the drying/fixing device 12.

For example, each recording substrate 14 is heated to a temperature higher than 100° C. by the conductive heat plate 30. By retrieving energy from the moisture that is condensed and from the heat energy of the exhausted air, the described recording substrate treatment apparatus 10 is particularly advantageous in high productivity printers or copiers using aqueous ink, where the amount of moisture that needs to be removed from re-cording substrates is large. For example, when large image areas are printed at a printing speed of 150 A4 pages per minute (ppm), the amount of moisture to be removed may be about 6 liters per hour. Thus, the energy content of the evaporated water in the form of latent heat is significant. The treatment apparatus allows to retrieve a substantial amount of the energy from the latent heat.

Figure 3:
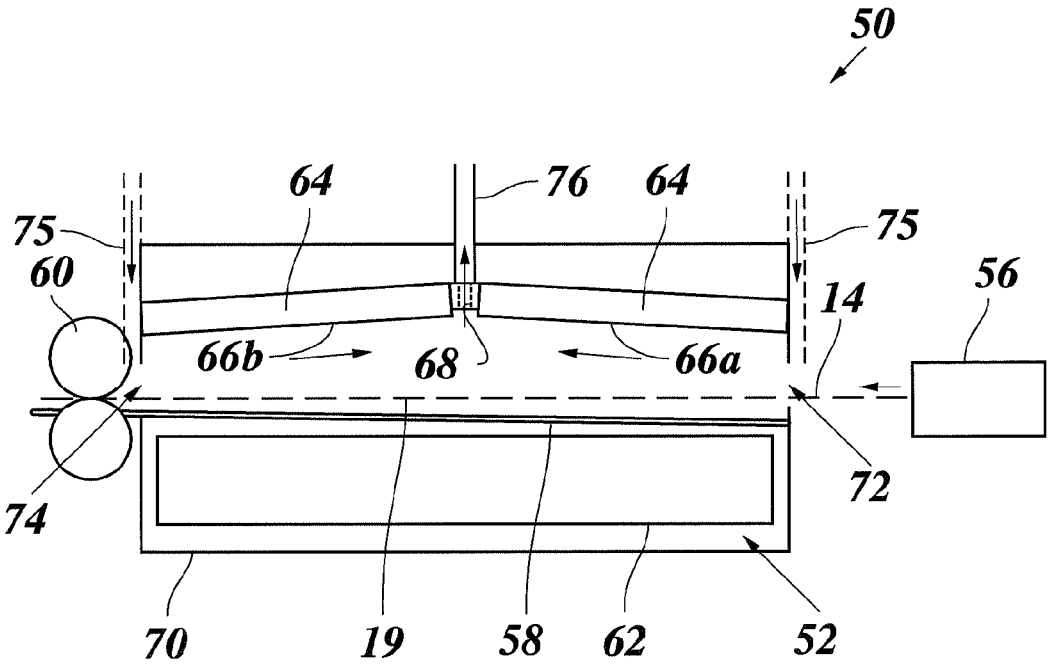
FIG. 3 is a schematic view of a second embodiment of a recording substrate treatment apparatus.

FIG. 3 schematically shows a second embodiment of a recording substrate treatment apparatus 50 of an image forming apparatus. The image forming apparatus is e.g. a laser printer.

The recording substrate treatment apparatus 50 comprises a fixing device 52 in the form of a fuser for fixing/fusing a printing substance, e.g. toner, on a recording substrate 14. The recording substrate 14 is transported from an image forming unit 56, e.g. a laser printing unit, by sheet transport means known as such in the art to and through the fixing device 52.

For example, the treatment apparatus 50 comprises support members 58 in the form of guide rails supporting the recording substrate 14 while it is transported through the treatment apparatus 50. Downstream of the treatment apparatus 50, for example, sheet trans-port rollers 60 are arranged that form a transport nip.

The fixing device 52 comprises a fusing unit 62 known as such in the art. For example, the fusing unit 62 comprises a radiant heater that forms a radiation source for melting the printing substance and thereby bonding it to the recording substrate 14.

For example, the fusing unit 62 is arranged on a first (bottom) side of the sheet transport path 19 that is schematically illustrated by a dashed line. For example, on a second (upper) side of the sheet transport path 19, an equalizing unit 64 for reducing temperature gradients in the space between the equalizing unit 64 and the fusing unit 62 is arranged.

For example, an upper boundary surface 66 of surroundings of the recording substrate transport path 19 is formed by the equalizing units 64. In the example shown, a first upper boundary surface 66*a* is arranged upstream of a second upper boundary surface 66*b*. The first upper boundary surface 66*a* slightly raises in the recording substrate transport direction, and the second upper boundary surface 66*b* slightly raises in the opposite direction.

Between the upper boundary surfaces 66*a*, 66*b*, there is arranged an outlet 68. That is, both upper boundary surfaces 66*a*, 66*b* raise towards the outlet 68.

As the recording substrate 14 is heated by the fusing unit 62 and heat reflecting equalizing units 64, liquid such as water evaporates from the recording substrate 14. Hot, moist air from the surroundings of the recording substrate 14 in a housing 70 of the fixing device 52 is guided by the upper boundary surfaces 66*a*, 66*b* towards the outlet 68 and is exhausted at the outlet 68.

For example, air transport along the boundary surfaces 66*a*, 66*b* may be due to the effect of warm air rising and being guided by the rising upper boundary surfaces 66*a*, 66*b* to the central outlet 68. By the natural flow of air flowing along the boundary surfaces 66*a*, 66*b* and leaving through the outlet 68, for example, subtle air flows of air entering the housing 70 at a recording substrate entry opening 72 and exit opening 74 may be generated. Thus, it may be prevented that moist hot air escapes the fixing device 52 at the openings 72, 74.

The equalizing units 64 are only one possible example for forming an upper boundary surface 66 that raises towards at least one outlet 68, and the upper boundary surfaces 66*a*, 66*b* may as well be formed by other structures or ceiling members of the fixing device 52.

For example, the upper boundary surfaces 66*a*, 66*b* raise towards the outlet 68 under a small angle with the respect to the horizontal direction, e.g. an angle of less than 45°. In an embodiment, said angle is less than 23°; or even less than 12°. For example, the angle or amount of rising of the boundary surface 66 may be chosen dependent on a desired natural flow rate of the hot air.

For example, the outlet 68 may be connected to a ventilation unit (FIG. 4) for exhausting air from surroundings of the recording substrate transport path 19 via the outlet 68.

For example, the outlet 68 may be formed by one or more small holes in a ceiling or upper boundary surface of surroundings of the recording substrate transport path 19.

For example, as indicated in FIG. 3 by dashed lines, the treatment apparatus 50 may further comprise at least one inlet for air at the recording substrate entry and/or exit openings 72, 74. The inlet may, for example, be connected to a conduit 75 for supplying dry air. In an embodiment, the dry air supply conduit 75 is arranged to supply a dry air stream on a printing substance carrying side of the recording substrate 14.

For example, the outlet 68 may be connected to a conduit 76 for receiving air from the outlet 68.

Figure 4:
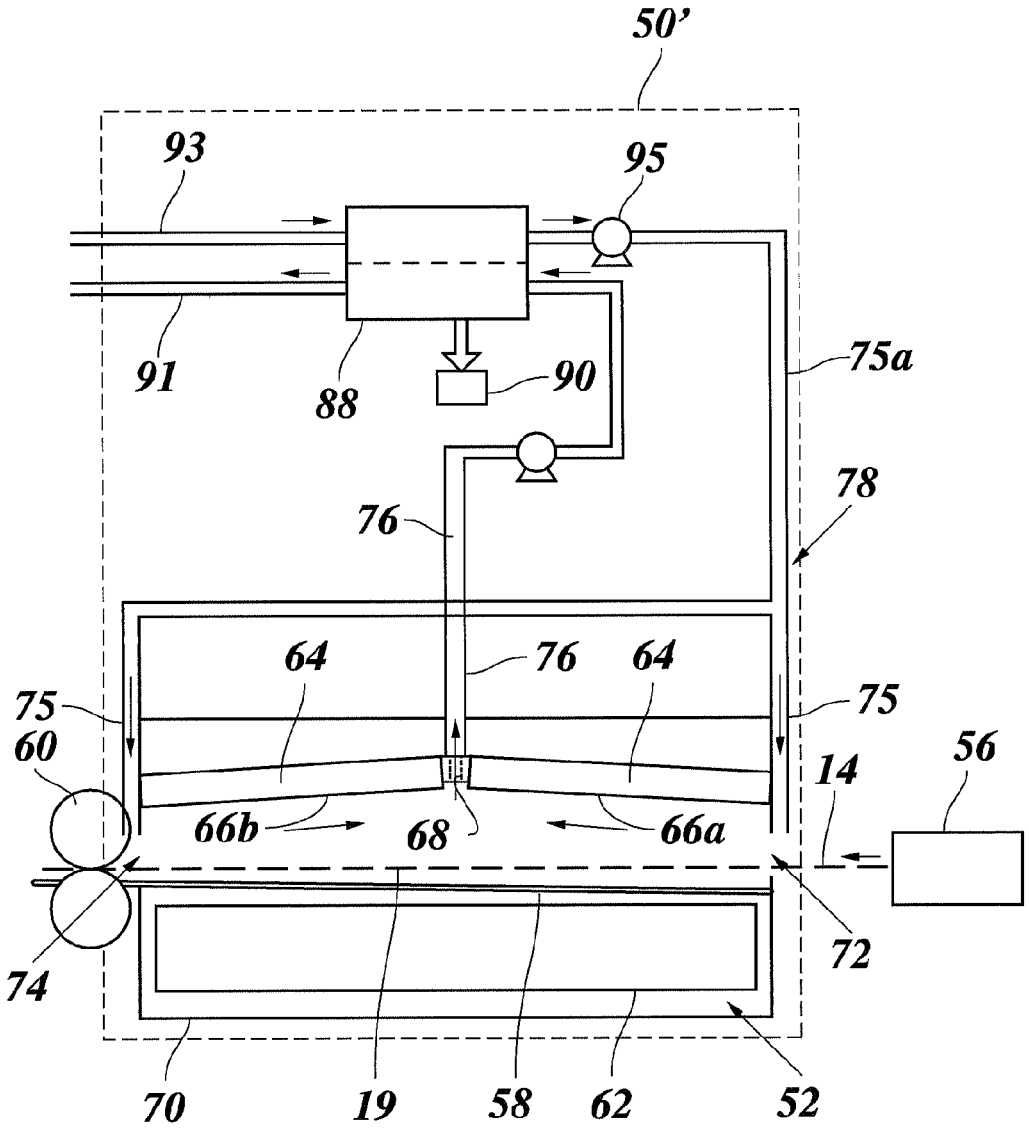
FIG. 4 is a schematic view of a further recording substrate treatment apparatus.

FIG. 4 schematically shows an image forming apparatus comprising a recording substrate treatment apparatus 50'. The image forming apparatus is e.g. a laser printer. The recording substrate treatment apparatus 50' includes the features and structures similar to that of the recording substrate treatment apparatus 50 of FIG. 3, as well as further features that will be described in the following. The same or similar elements are indicated with the same reference signs. For example, the recording substrate treatment apparatus 50 is part of the recording substrate treatment apparatus 50'.

In the recording substrate treatment apparatus 50', the recording substrate 14 is pre-heated by a heating device 78 comprising a first conduit 75 for transporting a heat transport fluid in the form of heated air to a recording substrate entry side of the fixing device 52. Furthermore, a second conduit 75 is arranged to transport the heated air also to a recording substrate exit side of the fixing device 52. Thereby, the heating device 78 is arranged for transferring heat through a heated air stream to the recording substrate 14.

As the recording substrate 14 is heated by the fusing unit 62 and heat reflecting equalizing units 64, liquid such as water evaporates from the recording substrate 14. Hot, moist air from the surroundings of the recording substrate 14 in a housing 70 of the fixing device 52 is guided by the upper boundary surfaces 66*a*, 66*b* towards the outlet 68 and is exhausted at the outlet 68 and transported via the conduit 76 to a condenser 88.

Similar to the condenser 38 of FIGS. 1 and 2, the condenser 88 condenses liquid from the air from conduit 76. The condensed liquid is collected in a reservoir 90. The condenser 88 comprises a heat exchanger. On a first side of the head exchanger of the condenser 88, the water is condensed from the air from conduit 76 and the air is cooled, and cooled air is provided at an air outlet 91 of the heat exchanger. On a second side of the heat exchanger, air is supplied from an air inlet 93, and energy from latent heat, which is released by said condensing of liquid by the condenser 88, is transferred to the air from the air inlet 93. The first and second sides of the heat exchanger of the condenser 88 are, for example, opposite sides of a separation wall of the heat exchanger.

The heated air stream from the second side of the heat exchanger is transferred through a conduit 75*a* to the heating device 78, in particular, to conduit 75. Thus, the conduit 75*a* and, for example, a blower 95 for pumping the air stream through conduits 75, 75*a*, form an energy transfer system for transferring energy from latent heat, which is released by said condensing of liquid by the condenser 88, to the heating device 78. It will be recognized by those skilled in the art, that the blower 95 or other air stream generating means may be arranged at any suitable location in an air supply duct comprising the air inlet 93, the conduits 75, 75*a* and the heating device 78 and/or at a suitable location at an air exhaust side of the fixing device 52, including the conduit 76 and the air outlet 91.

Similar to the heat exchanger of the condenser 38 of FIGS. 1 and 2, the heat exchanger of the condenser 88 is adapted for condensing liquid from air from surroundings of a recording substrate 14 and thereby providing cooled air, and for providing energy from latent heat, which is released by said condensing of liquid, wherein said energy is provided separate from said cooled air.

In both examples, the energy transfer system is arranged for transferring energy from waste heat of the condenser 38 or 88 to the heating device 28 or 78, respectively. Latent heat from the hot, moist air is transported out of the condenser 38, 88 by a heat transport fluid, which is, for example, a circulating refrigerant in the first embodiment and a hot air stream in the second embodiment.

In FIG. 4, the dry air supply conduit 75 of the heating device 78 is arranged to supply the hot, dry air stream on a printing substance carrying side of the recording substrate 14. For example, the hot air stream is supplied directly at a recording substrate entry opening 72 and/or a recording substrate exit opening 74 of the housing 70. Thus, the air stream contributes to guiding the printing substrate 14 into/out of the housing 70. The possibility of the recording substrate 14 touching a boundary of the entry opening 72 and/or exit opening 74 with the toner side of the printing substrate is significantly reduced. Further, the height of an entry slit (opening 72) or exit slit (opening 74) may be reduced, thereby reducing hot air loss.

It is noted that in the example of FIG. 4, the fixing device 52 comprises a fusing unit 62 that is separate from the heating device 78 of the recording substrate treatment apparatus. For example, the fusing unit 62 may comprise a second heating device for fixing (fusing) the printing substance to the recording substrate 14, the second heating device being separate from the first heating device 78. For example, the heating device 78 may be a part of the fixing device 52.

The invention being thus described, it will be obvious that the same may be varied in many ways.

For example, the heating device 28 of FIG. 1 may comprise a support member 32 in the form of a drum or roller. For example, a heated drum may be provided instead of the heat plate 30, and the recording substrate 14 may be supported directly on the drum or by a belt guided around the drum. Other sheet transport means 20 than belts 24 and rollers 26 may be provided, as well.

For example, the fixing device 52 may comprise a fusing unit that comprises a fusing roller that is equipped with a radiation source, and a support roller (support member) for melting the printing substance and bonding it to the recording substrate 14 in the pressure between the rollers.

For example, instead of providing an air inlet from conduit 75 at the recording substrate exit opening 74, a central outlet 68 connected to the conduit 76, and rising upper boundary surfaces for guiding hot air to the central outlet 68, the conduit 76 may be arranged at an air exhaust side of the housing 70 directly at a recording substrate exit opening 74.

For example, similar to the configuration of FIGS. 3 and 4, at least one outlet 68 for air from surroundings of the recording substrate transport path 19, and at least one upper boundary surface 66 of surroundings of the recording substrate transport path 19, which boundary surface 66 rises towards said at least one outlet 68 for guiding hot air towards said at least one outlet, may be provided to the apparatus of FIGS. 1 and 2.

For example, in the apparatus of FIGS. 1 and 2, conduit 42 may be arranged to supply the dry air stream on a printing substance carrying side of the recording substrate 14. For example, the dry air stream may be supplied directly at a recording substrate entry opening and/or a recording substrate exit opening of the housing 34, e.g. similar to the configuration of conduits 75 described above.

The embodiments as described above have the specific advantage that a controlled air stream may be provided in the drying/fixing device 12 or fixing device 52. This is especially advantageous in order to ensure proper operation of a radiation fusing unit. This is furthermore advantageous in order to minimize or avoid uncontrolled hot air streams escaping the device at recording substrate entry and/or exit openings.

The embodiments of FIGS. 1, 2 and 4 as described above have further specific advantages as follows:

Waste heat from the condenser is retrieved, so that the environment of the image forming apparatus is less warmed.

The liquid is condensed out of the exhaust air from the drying/fixing device 12 or fixing device 52, so that possible problems arising from moist air entering other parts of the image forming apparatus may be prevented.

The invention claimed is:

1. A recording substrate treatment apparatus, comprising:

a heating device for directly heating a recording substrate;

a condenser for condensing liquid from air from surroundings of the recording substrate;

an energy transfer system arranged for transferring energy from latent heat, which is released by said condensing of liquid by the condenser, to the heating device; and a conduit for supplying to the recording substrate or another recording substrate a stream of air cooled by the condenser.

2. The recording substrate treatment apparatus according to claim 1, wherein the treatment apparatus comprises at least one of a drying device for drying the recording substrate or another recording substrate and a fixing device for fixing a printing substance on the recording substrate or another recording substrate.

3. The recording substrate treatment apparatus according to claim 2, wherein the condenser comprises a heat exchanger adapted for condensing liquid from air at a first side of the heat exchanger and for providing energy from latent heat, which is released by said condensing of liquid, at a second side of the heat exchanger, the second side being separate from said first side.

4. The recording substrate treatment apparatus according to claim 1, wherein the condenser comprises a heat exchanger adapted for condensing liquid from air at a first side of the heat exchanger and for providing energy from latent heat, which is released by said condensing of liquid, at a second side of the heat exchanger, the second side being separate from said first side.

5. The recording substrate treatment apparatus according to claim 1, wherein the heating device comprises a support member for supporting the recording substrate and directly heating the recording substrate.

6. The recording substrate treatment apparatus according to claim 1, wherein the heating device is adapted for using a heat transport fluid for transferring heat.

7. The recording substrate treatment apparatus according to claim 1, wherein the energy transfer system comprises a heat transport fluid for transferring energy from latent heat, which is released by said condensing of liquid by the condenser, to the heating device.

8. The recording substrate treatment apparatus according to claim 1, wherein the energy transfer system comprises a heat pump.

9. The recording substrate treatment apparatus according to claim 1, wherein the recording substrate treatment apparatus further comprises:

at least one outlet for air from surroundings of a recording substrate transport path, and an upper boundary surface of surroundings of a recording substrate transport path, which boundary surface rises towards said at least one outlet for guiding hot air towards said at least one outlet.

10. An image forming apparatus, comprising a recording substrate treatment apparatus according to claim 1.

11. The recording substrate treatment apparatus according to claim 1, wherein the treatment apparatus comprises at least one of a drying device for drying the recording substrate or another recording substrate and a fixing device for fixing a printing substance on the recording substrate or another recording substrate.

12. The recording substrate treatment apparatus according to claim 1, wherein the condenser comprises a heat exchanger adapted for condensing liquid from air at a first side of the heat exchanger and for providing energy from latent heat, which is released by said condensing of liquid, at a second side of the heat exchanger, the second side being separate from said first side.

13. The recording substrate treatment apparatus according to claim 1, wherein the heating device comprises a support member for supporting the recording substrate and directly heating the recording substrate.

14. A recording substrate treatment apparatus, comprising:

a heating device for directly heating a recording substrate;

a condenser for condensing liquid from air from surroundings of the recording substrate;

an energy transfer system arranged for transferring energy from latent heat, which is released by said condensing of liquid by the condenser, to the heating device, wherein an air supply conduit is arranged to supply an air stream on a printing substance carrying side of the recording substrate at at least one of a printing substrate entry opening and a printing substrate exit opening of the recording substrate treatment apparatus.

15. The image forming apparatus according to claim 14, wherein the image forming apparatus comprises an image forming unit for printing at least one printing substance onto the recording substrate or another recording substrate.

16. A method of drying a recording substrate, comprising the steps of:

heating the recording substrate by a heating device that directly heats the recording substrate;

condensing liquid from air from surroundings of the recording substrate by a condenser; and transferring energy from latent heat, which is released by said condensing of liquid, to said heating device; and supplying, by a conduit, a stream of air cooled by the condenser to the recording substrate or another recording substrate.

17. The method according to claim 16, further comprising the step of:

guiding air from surroundings of the recording substrate to at least one outlet by an upper boundary surface of surroundings of a recording substrate transport path, which boundary surface rises towards said at least one outlet.

18. A method of fixing a printing substance on a recording substrate, comprising the steps of:

heating the recording substrate by a heating device that directly heats the recording substrate;

condensing liquid from air from surroundings of the recording substrate by a condenser; and transferring energy from latent heat, which is released by said condensing of liquid, to said heating device; and supplying, by a conduit, a stream of air cooled by the condenser to the recording substrate or another recording substrate.

19. The method according to claim 18, further comprising the step of:

guiding air from surroundings of the recording substrate to at least one outlet by an upper boundary surface of surroundings of a recording substrate transport path, which boundary surface rises towards said at least one outlet.

* * * * *